US007347881B2

(12) United States Patent
Krull et al.

(10) Patent No.: US 7,347,881 B2
(45) **Date of Patent: *Mar. 25, 2008**

(54) LOW-SULPHUR MINERAL OIL DISTILLATES WITH IMPROVED COLD PROPERTIES, CONTAINING AN ESTER OF AN ALKOXYLATED POLYOL AND A COPOLYMER OF ETHYLENE AND UNSATURATED ESTERS

(75) Inventors: Matthias Krull, Harxheim (DE); Martina Hess, Mülheim a. d. Ruhr (DE)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 571 days.

This patent is subject to a terminal disclaimer.

(21) Appl. No.: 10/495,558

(22) PCT Filed: Nov. 2, 2002

(86) PCT No.: PCT/EP02/12233

§ 371 (c)(1),
(2), (4) Date: May 12, 2004

(87) PCT Pub. No.: WO03/042337

PCT Pub. Date: May 22, 2003

(65) Prior Publication Data

US 2004/0255511 A1 Dec. 23, 2004

(30) Foreign Application Priority Data

Nov. 14, 2001 (DE) ..... 101 55 748

(51) Int. Cl.
*C10L 1/18* (2006.01)

(52) U.S. Cl. ..... 44/388; 44/443; 44/450

(58) Field of Classification Search ..... 44/433
See application file for complete search history.

(56) References Cited

U.S. PATENT DOCUMENTS

| | | | | |
|---|---|---|---|---|
| 3,762,888 | A * | 10/1973 | Kober et al. | 44/349 |
| 4,464,182 | A | 8/1984 | Tack et al. | |
| 5,186,720 | A | 2/1993 | Feustel et al. | |
| 5,200,484 | A | 4/1993 | Reimann | |
| 5,254,652 | A | 10/1993 | Feustel et al. | |
| 5,391,632 | A | 2/1995 | Krull et al. | |
| 5,618,779 | A | 4/1997 | Klein et al. | |
| 5,767,190 | A | 6/1998 | Krull et al. | |
| 5,789,510 | A | 8/1998 | Krull et al. | |
| 5,993,498 | A * | 11/1999 | Vrahopoulou et al. | 44/388 |
| 5,998,530 | A | 12/1999 | Krull et al. | |
| 6,248,142 | B1 | 6/2001 | Caprotti | |
| 6,554,876 | B1 | 4/2003 | Tack et al. | |
| 6,803,492 | B2 * | 10/2004 | Feustel et al. | 585/1 |

FOREIGN PATENT DOCUMENTS

| | | |
|---|---|---|
| CA | 127 1895 | 7/1990 |
| CA | 2020104 | 12/1990 |
| EP | 0973850 | 10/1998 |
| EP | 108 8045 | 12/1999 |
| GB | WO9417160 | * 8/1994 |

OTHER PUBLICATIONS

Abstract JP 61 1811892, Aug. 14, 1986.
Abstract EP 027 1738, Jun. 22, 1988.
Abstract EP 0491255, Jun. 24, 1992.

* cited by examiner

*Primary Examiner*—Cephia D. Toomer
(74) *Attorney, Agent, or Firm*—Richard P. Silverman

(57) ABSTRACT

A middle distillate having a maximum um sulfur content of 0.05% by weight and containing fatty acid esters of alkoxylated polyols having at least 3 OH groups (A) and also at least one cold flow improver (B). The cold flow improver includes at least one copolymer of ethylene and one or more ethylenically unsaturated carboxylic esters having an ethylene portion of from 60 to 90 mol %.

10 Claims, No Drawings

LOW-SULPHUR MINERAL OIL DISTILLATES WITH IMPROVED COLD PROPERTIES, CONTAINING AN ESTER OF AN ALKOXYLATED POLYOL AND A COPOLYMER OF ETHYLENE AND UNSATURATED ESTERS

The invention relates to low-sulfur mineral oil distillates having improved cold flowability and paraffin dispersancy, comprising an ester of an alkoxylated polyol and a copolymer of ethylene and unsaturated esters, to paraffin-dispersing additives and their use.

In view of the decreasing mineral oil reserves coupled with steadily rising energy demand, ever more problematic crude oils are being extracted and processed. In addition, the demands on the fuel oils, such as diesel and heating oil, produced therefrom are becoming ever more stringent, not least as a result of legislative requirements. Examples thereof are the reduction in the sulfur content, the limitation of the final boiling point and also of the aromatics content of middle distillates, which force the refineries into constant adaptation of the processing technology. In middle distillates, this leads in many cases to an increased proportion of paraffins, especially in the chain length range of from $C_{18}$ to $C_{24}$, which in turn has a negative influence on the cold flow properties of these fuel oils.

Crude oils and middle distillates, such as gas oil, diesel oil or heating oil, obtained by distillation of crude oils contain, depending on the origin of the crude oils, different amounts of n-paraffins which crystallize out as platelet-shaped crystals when the temperature is reduced and sometimes agglomerate with the inclusion of oil. This crystallization and agglomeration causes a deterioration in the flow properties of these oils or distillates, which may result in disruption, for example, in the course of recovery, extraction, storage and/or use of the mineral oils and mineral oil distillates. When mineral oils are transported through pipelines, the crystallization phenomenon can, especially in winter, lead to deposits on the pipe walls, and in individual cases, for example in the event of stoppage of a pipeline, even to its complete blockage. When storing and further processing the mineral oils, it may also be necessary in winter to store the mineral oils in heated tanks. In the case of mineral oil distillates, the consequence of crystallization may be blockages of the filters in diesel engines and boilers, which prevents reliable metering of the fuels and in some cases results in complete interruption of the fuel or heating medium feed.

In addition to the classical methods of eliminating the crystallized paraffins (thermally, mechanically or using solvents), which merely involve the removal of the precipitates which have already formed, chemical additives (known as flow improvers) have been developed in recent years. By interacting physically with the precipitating paraffin crystals, they bring about modification of their shape, size and adhesion properties. The additives function as additional crystal seeds and some of them crystallize out with the paraffins, resulting in a larger number of smaller paraffin crystals having modified crystal shape. The modified paraffin crystals have a lower tendency to agglomerate, so that the oils admixed with these additives can still be pumped and processed at temperatures which are often more than 20° C. lower than in the case of nonadditized oils.

Typical flow improvers for crude oils and middle distillates are co- and terpolymers of ethylene with carboxylic esters of vinyl alcohol.

A further task of flow improver additives is the dispersion of the paraffin crystals, i.e. the retardation or prevention of the sedimentation of the paraffin crystals and therefore the formation of a paraffin-rich layer at the bottom of storage vessels.

The prior art also discloses certain poly(oxyalkylene) compounds and also alkylphenol resins which are added as additives to middle distillates.

EP-A-0 061 895 discloses cold flow improvers for mineral oil distillates which comprise esters, ethers or mixtures thereof. The esters/ethers contain two linear saturated $C_{10}$- to $C_{30}$-alkyl groups and a polyoxyalkylene group having from 200 to 5000 g/mol.

EP-0 973 848 and EP-0 973 850 disclose mixtures or esters of alkoxylated alcohols having more than 10 carbon atoms and fatty acids having 10-40 carbon atoms in combination with ethylene copolymers as flow improvers.

EP-A-0 935 645 discloses alkylphenol-aldehyde resins as a lubricity-improving additive in low-sulfur middle distillates.

EP-A-0857776 and EP 1088045 disclose processes for improving the flowability of paraffinic mineral oils and mineral oil distillates by adding ethylene copolymers and alkylphenol-aldehyde resins, and also optionally further, nitrogen-containing paraffin dispersants.

The above-described flow-improving and/or paraffin-dispersing action of the existing paraffin dispersants is not always adequate, so that sometimes large paraffin crystals form when the oils are cooled and lead to filter blockages and, as a consequence of their relatively high density, sediment in the course of time and thus lead to the formation of a paraffin-rich layer at the bottom of the storage vessels. Problems occur in particular in the additization of paraffin-rich and narrow-cut distillation cuts having boiling ranges from 20-90% by volume of less than 120° C., in particular less than 100° C. The situation is particularly problematic in the case of low-sulfur winter qualities having cloud points below −5° C.; the addition of existing additives here often cannot achieve adequate filterability and paraffin dispersancy at low temperatures.

It is therefore an object of the invention to improve the flowability, and in particular the filterability at low temperatures and also the paraffin dispersancy, in the case of mineral oils and mineral oil distillates, by the addition of suitable additives.

It has been found that, surprisingly, an additive which comprises, in addition to copolymers of ethylene and unsaturated esters, also fatty acid esters of certain alkoxylated polyols constitutes a particularly good cold flow improver.

The invention therefore provides middle distillates having a maximum sulfur content of 0.05% by weight and containing fatty acid esters of alkoxylated polyols having at least 3 OH groups (A) and also at least one cold flow improver (B), said cold flow improver comprising at least one copolymer of ethylene and one or more ethylenically unsaturated carboxylic esters, having an ethylene fraction of from 60 to 90 mol %.

The invention further provides the use of an additive which contains at least one fatty acid ester of alkoxylated polyols having at least 3 OH groups (A) and also at least one cold flow improver (B), said cold flow improver comprising at least one copolymer of ethylene and one or more ethylenically unsaturated carboxylic esters, having an ethylene fraction of from 60 to 90 mol % for improving the cold flow properties and paraffin dispersancy of middle distillates having a maximum sulfur content of 0.05% by weight.

The invention further provides a process for improving the cold flow properties of middle distillates having a maximum sulfur content of 0.05% by weight, by adding to the middle distillates an additive containing at least one fatty acid ester of alkoxylated polyols having at least 3 OH groups (A) and at least one cold flow improver (B), said cold flow improver comprising at least one copolymer of ethylene and one or more ethylenically unsaturated carboxylic esters, having an ethylene fraction of from 60 to 90 mol %.

The esters (A) derive from polyols having 3 or more OH groups, in particular from glycerol, trimethylolpropane, pentaerythritol, and also the oligomers obtainable therefrom by condensation and having from 2 to 10 monomer units, for example polyglycerol. The polyols have generally been reacted with from 1 to 100 mol of alkylene oxide, preferably from 3 to 70 mol, in particular from 5 to 50 mol, of alkylene oxide, per mole of polyol. Preferred alkylene oxides are ethylene oxide, propylene oxide and butylene oxide. The alkoxylation is effected by known processes.

The fatty acids which are suitable for the esterification of the alkoxylated polyols preferably have from 8 to 50, in particular from 12 to 30, especially from 16 to 26, carbon atoms. Suitable fatty acids are, for example, lauric acid, tridecanoic acid, myristic acid, pentadecanoic acid, palmitic acid, margaric acid, stearic acid, isostearic acid, arachic acid and behenic acid, oleic acid and erucic acid, palmitoleic acid, myristoleic acid, ricinoleic acid, and also fatty acid mixtures obtained from natural fats and oils. Preferred fatty acid mixtures contain more than 50% of fatty acids having at least 20 carbon atoms. Preferably, less than 50% of the fatty acids used for esterification contain double bonds, in particular less than 10%; they are especially very substantially saturated. Very substantially saturated means here an iodine number of the fatty acids used of up to 5 g of I per 100 g of fatty acid. The esterification may also be effected starting from reactive derivatives of the fatty acids such as esters with lower alcohols (for example methyl or ethyl esters) or anhydrides.

To esterify the alkoxylated polyols, mixtures of the above fatty acids with fat-soluble, polybasic carboxylic acids may also be used. Examples of suitable polybasic carboxylic acids are dimer fatty acids, alkenylsuccinic acids and aromatic polycarboxylic acids, and also their derivatives such as anhydrides and $C_1$- to $C_5$-esters. Preference is given to alkenylsuccinic acid and its derivatives with alkyl radicals having from 8 to 200, in particular from 10 to 50, carbon atoms. Examples are dodecenyl-, octadecenyl- and poly (isobutenyl)succinic anhydride. Preference is given to using the polybasic carboxylic acids in minor amounts of up to 30 mol %, preferably from 1 to 20 mol %, in particular from 2 to 10 mol %.

Esters and fatty acids are used for the esterification, based on the content of hydroxyl groups on the one hand and carboxyl groups on the other hand, in a ratio of from 1.5:1 to 1:1.5, preferably from 1.1:1 to 1:1.1, in particular equimolar. The paraffin-dispersing action is particularly marked when operation is effected with an acid excess of up to 20 mol %, especially up to 10 mol %, in particular up to 5 mol %.

The esterification is carried out by customary processes. It has been found to be particularly useful to react polyol alkoxylate with fatty acid, optionally in the presence of catalysts, for example para-toluenesulfonic acid, $C_2$- to $C_{50}$-alkylbenzenesulfonic acids, methanesulfonic acid or acidic ion exchangers. The water of reaction may be removed distillatively by direct condensation or preferably by means of azeotropic distillation in the presence of organic solvents, in particular aromatic solvents, such as toluene, xylene or else relatively high-boiling mixtures such as ®Shellsol A, Shellsol B, Shellsol AB or Solvent Naphtha. The esterification is preferably effected to completion, i.e. from 1.0 to 1.5 mol of fatty acid are used for the esterification per mole of hydroxyl groups. The acid number of the esters is generally below 15 mg KOH/g, preferably below 10 mg KOH/g, especially below 5 mg KOH/g.

Copolymer (B) is preferably an ethylene copolymer having an ethylene content of from 60 to 90 mol % and a comonomer content of from 10 to 40 mol %, preferably from 12 to 18 mol %. Copolymer (B) is more preferably a main-chain polymer which is not a graft copolymer. Suitable comonomers are vinyl esters of aliphatic carboxylic acids having from 2 to 15 carbon atoms. Preferred vinyl esters for copolymer (B) are vinyl acetate, vinyl propionate, vinyl hexanoate, vinyl octanoate, vinyl-2-ethylhexanoate, vinyl laurate and vinyl esters of neocarboxylic acids, here in particular of neononanoic, neodecanoic and neoundecanoic acid. Particular preference is given to an ethylene-vinyl acetate copolymer, an ethylene-vinyl propionate copolymer, an ethylene-vinyl acetate-vinyl octanoate terpolymer, an ethylene-vinyl acetate-vinyl 2-ethylhexanoate terpolymer, an ethylene-vinyl acetate-vinyl neononanoate terpolymer or an ethylene-vinyl acetate-vinyl neodecanoate terpolymer. Preferred acrylic esters are acylic esters with alcohol radicals having from 1 to 20, in particular from 2 to 12 and especially from 4 to 8, carbon atoms, for example methyl acrylate, ethyl acrylate and 2-ethylhexyl acrylate. The copolymers may contain up to 5% by weight of further comonomers. Such comonomers may be, for example, vinyl esters, vinyl ethers, alkyl acrylates, alkyl methacrylates having $C_1$- to $C_{20}$-alkyl radicals, isobutylene and olefins. Preferred as higher olefins are hexene, isobutylene, octene and/or diisobutylene. Further suitable comonomers are olefins such as propene, hexene, butene, isobutene, diisobutylene, 4-methylpentene-1 and norbornene. Particular preference is given to ethylene-vinyl acetate-diisobutylene and ethylene-vinyl acetate-4-methylpentene-1 terpolymers.

The copolymers preferably have melt viscosities at 140° C. of from 20 to 10 000 mPas, in particular from 30 to 5000 mPas, especially from 50 to 2000 mPas.

The copolymers (B) can be prepared by the customary copolymerization processes, for example suspension polymerization, solution polymerization, gas phase polymerization or high pressure bulk polymerization. Preference is given to high pressure bulk polymerization at pressures of preferably from 50 to 400 MPa, in particular from 100 to 300 MPa, and temperatures of preferably from 50 to 350° C., in particular from 100 to 250° C. The reaction of the monomers is initiated by radical-forming initiators (radical chain starters). This substance class includes, for example, oxygen, hydroperoxides, peroxides and azo compounds, such as cumene hydroperoxide, t-butyl hydroperoxide, dilauroyl peroxide, dibenzoyl peroxide, bis(2-ethylhexyl) peroxide carbonate, t-butyl perpivalate, t-butyl permaleate, t-butyl perbenzoate, dicumyl peroxide, t-butyl cumyl peroxide, di-(t-butyl) peroxide, 2,2'-azobis(2-methylpropionitrile), 2,2'-azobis(2-methylbutyronitrile). The initiators are used individually or as a mixture of two or more substances in amounts of from 0.01 to 20% by weight, preferably from 0.05 to 10% by weight, based on the monomer mixture.

The high pressure bulk polymerization is carried out in known high pressure reactors, for example autoclaves or tubular reactors, batchwise or continuously, and tubular reactors have been found to be particularly useful. Solvents such as aliphatic and/or aromatic hydrocarbons or hydrocarbon mixtures, benzene or toluene may be present in the reaction mixture. Preference is given to working without solvent. In a preferred embodiment of the polymerization, the mixture of the monomers, the initiator and, where used, the moderator are fed to a tubular reactor via the reactor inlet and also via one or more side branches. The monomer streams may have different compositions (EP-A-0 271 738).

Suitable co- or terpolymers include, for example:

- ethylene-vinyl acetate copolymers having from 10 to 40% by weight of vinyl acetate and 60-90% by weight of ethylene;
- the ethylene-vinyl acetate-hexene terpolymers disclosed by DE-A-34 43 475;
- the ethylene-vinyl acetate-diisobutylene terpolymers described in EP-B-0 203 554;
- the mixture of an ethylene-vinyl acetate-diisobutylene terpolymer and an ethylene-vinyl acetate copolymer disclosed by EP-B-0 254 284;
- the mixtures of an ethylene-vinyl acetate copolymer and an ethylene-vinyl acetate-N-vinylpyrrolidone terpolymer disclosed in EP-B-0 405 270;
- the ethylene-vinyl acetate-isobutyl vinyl ether terpolymers described in EP-B-0 463 518;
- the copolymers of ethylene with vinyl alkylcarboxylates disclosed in EP-B-0 491 225;
- the ethylene-vinyl acetate-vinyl neononanoate or -vinyl neodecanoate terpolymers which are disclosed by EP-B-0 493 769 and, apart from ethylene, contain from 10 to 35% by weight of vinyl acetate from and 1 to 25% by weight of the particular neo compound;
- the terpolymers, described in DE-A-196 20 118, of ethylene, the vinyl ester of one or more aliphatic $C_2$- to $C_{20}$-monocarboxylic acids and 4-methylpentene-1;
- the terpolymers, disclosed in DE-A-196 20 119, of ethylene, the vinyl ester of one or more aliphatic $C_2$- to $C_{20}$-monocarboxylic acids and bicyclo[2.2.1]hept-2-ene.

In a preferred embodiment of the invention, to the fuel oils according to the invention which contain the constituents (A) and (B) may also be added alkylphenol-aldehyde resins (C), paraffin dispersants (D) and/or comb polymers. Preferred embodiments are consequently also the use according to the invention of additives which additionally comprise alkylphenol-aldehyde resins (C), paraffin dispersants (D) and/or comb polymers, and the corresponding process.

Alkylphenol-aldehyde resins (C) are known in principle and are described, for example, in Römpp Chemie Lexikon, 9th edition, Thieme Verlag 1988-92, volume 4, p. 3351 ff. The alkyl radicals of the o- or p-alkylphenol have 1-50, preferably 4-20, in particular 6-12, carbon atoms; they are preferably n-, iso- and tert-butyl, n- and isopentyl, n- and isohexyl, n- and isooctyl, n- and isononyl, n- and isodecyl, n- and isododecyl, and also tetrapropenyl, pentapropenyl and polyisobutenyl. The alkylphenol-aldehyde resin may also contain up to 50 mol % of phenol units. For the alkylphenol-aldehyde resin, identical or different alkylphenols may be used. The aliphatic aldehyde in the alkylphenol-aldehyde resin has from 1 to 10, preferably from 1 to 4, carbon atoms, and may bear further functional groups such as aldehyde or carboxyl groups. It is preferably formaldehyde. The molecular weight of the alkylphenol-aldehyde resins is 400-10 000 g/mol, preferably 400-5000 g/mol. A prerequisite is that the resins are oil-soluble.

The alkylphenol-aldehyde resins are prepared in a known manner by basic catalysis to form condensation products of the resol type or by acidic catalysis to form condensation products of the novolak type. The condensates obtained in both ways are suitable for the compositions according to the invention. Preference is given to condensing in the presence of acidic catalysts.

To prepare the alkylphenol-aldehyde resins, a bifunctional o- or p-alkylphenol having from 1 to 50 carbon atoms, preferably from 4 to 20, in particular from 6 to 12, carbon atoms, per alkyl group, or mixtures thereof, and an aliphatic aldehyde having from 1 to 10 carbon atoms are reacted together, using from 0.5 to 2 mol, preferably from 0.7 to 1.3 mol and in particular equimolar amounts, of aldehyde per mole of alkylphenol compound.

Suitable alkylphenols are in particular $C_4$- to $C_{50}$-alkylphenols, for example o- or p-cresol, n-, sec- and tert-butylphenol, n- and i-pentylphenol, n- and isohexylphenol, n- and isooctylphenol, n- and isononylphenol, n- and isodecylphenol, n- and isododecylphenol, tetradecylphenol, hexadecylphenol, octadecylphenol, eicosylphenol, tripropenylphenol, tetrapropenylphenol and poly(isobutenyl)phenol.

The alkylphenols are preferably para-substituted. Preferably at most 7 mol %, in particular at most 3 mol %, of them are substituted by more than one alkyl group.

Particularly suitable aldehydes are formaldehyde, acetaldehyde, butyraldehyde and glutaraldehyde; preference is given to formaldehyde.

The formaldehyde may be used in the form of paraformaldehyde or in the form of a preferably from 20 to 40% by weight aqueous formalin solution. Appropriate amounts of trioxane may also be used.

Alkylphenol and aldehyde are typically reacted in the presence of alkaline catalysts, for example alkali metal hydroxides or alkylamines, or of acidic catalysts, for example inorganic or organic acids such as hydrochloric acid, sulfuric acid, phosphoric acid, sulfonic acid, sulfamido acids or haloacetic acids, and in the presence of an organic solvent which forms an azeotrope with water, for example toluene, xylene, higher aromatics or mixtures thereof. The reaction mixture is heated to a temperature of from 90 to 200° C., preferably from 100 to 160° C., and the water of reaction formed during the reaction is removed by azeotropic distillation. Solvents which do not release any protons under the conditions of the condensation may remain in the products after the condensation reaction. The resins may be used directly or after neutralization of the catalyst, optionally after further dilution of the solution with aliphatic and/or aromatic hydrocarbons or hydrocarbon mixtures, for example benzine fractions, kerosene, decane, pentadecane, toluene, xylene, ethylbenzene or solvents such as ®Solvent Naphtha, ®Shellsol AB, ®Solvesso 150, ®Solvesso 200, ®Exxsol, ®ISOPAR and ®Shellsol D types.

The alkylphenol resins may subsequently optionally be alkoxylated by reacting with from 1 to 10 mol, especially from 1 to 5 mol, of alkylene oxide such as ethylene oxide, propylene oxide or butylene oxide, per phenolic OH group.

The polar nitrogen-containing paraffin dispersants (D) are low molecular weight or polymeric, oil-soluble nitrogen compounds, for example amine salts, imides and/or amides, which are obtained by reacting aliphatic or aromatic amines, preferably long-chain aliphatic amines, with aliphatic or aromatic mono-, di-, tri- or tetracarboxylic acids or their anhydrides. Particularly preferred paraffin dispersants comprise reaction products of secondary fatty amines having from 8 to 36 carbon atoms, in particular dicoconut fatty amine, ditallow fatty amine and distearylamine. Other paraffin dispersants are copolymers of maleic anhydride and α,β-unsaturated compounds which may optionally be reacted with primary monoalkylamines and/or aliphatic alcohols, the reaction products of alkenyl-spiro-bislactones with amines and reaction products of terpolymers based on α,β-unsaturated dicarboxylic anhydrides, α,β-unsaturated compounds and polyoxyalkylene ethers of lower unsaturated alcohols. Some suitable paraffin dispersants (D) are listed hereinbelow.

Some of the paraffin dispersants (D) specified below are prepared by reacting compounds which contain an acyl group with an amine. This amine is a compound of the formula $NR^6R^7R^8$ where $R^6$, $R^7$ and $R^8$ may be the same or different, and at least one of these groups is $C_8$-$C_{36}$-alkyl, $C_6$-$C_{36}$-cycloalkyl, $C_8$-$C_{36}$-alkenyl, in particular $C_{12}$-$C_{24}$-alkyl, $C_{12}$-$C_{24}$-alkenyl or cyclohexyl, and the remaining groups are either hydrogen, $C_1$-$C_{36}$-alkyl, $C_2$-$C_{36}$-alkenyl, cyclohexyl, or a group of the formulae $—(A—O)_x—E$ or $—(CH_2)_n—NYZ$, where A is an ethylene or propylene group, x is a number from 1 to 50, E=H, $C_1$-$C_{30}$-alkyl, $C_5$-$C_{12}$-cycloalkyl or $C_6$-$C_{30}$-aryl, and n is 2, 3 or 4, and Y and Z are each independently H, $C_1$-$C_{30}$-alkyl or $—(A—O)_x$. An acyl group here is a functional group of the following formula:

>C=O

1. Reaction products of alkenyl-spiro-bislactones of the formula

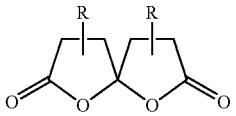

where R is in each case $C_8$-$C_{200}$-alkenyl with amines of the formula $NR^6R^7R^8$. Suitable reaction products are detailed in EP-A-0 413 279. Depending on the reaction conditions, the reaction of compounds of the formula with amine results in amides or amide-ammonium salts.

2. Amides or ammonium salts of aminoalkylene polycarboxylic acids with secondary amines of the formula

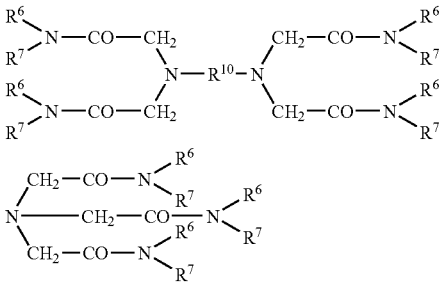

in which $R^{10}$ is a straight-chain or branched alkylene radical having from 2 to 6 carbon atoms or the radical of the formula

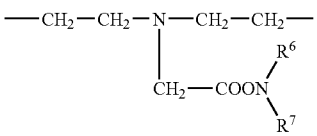

in which $R^6$ and $R^7$ are in particular alkyl radicals having from 10 to 30, preferably from 14 to 24, carbon atoms, and the amide structures may also partly or completely be in the form of the ammonium salt structure of the formula

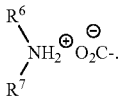

The amides or amide-ammonium salts or ammonium salts, for example of nitrilotriacetic acid, of ethylenediaminetetraacetic acid or of propylene-1,2-diaminetetraacetic acid are obtained by reacting the acids with from 0.5 to 1.5 mol of amine, preferably from 0.8 to 1.2 mol of amine, per carboxyl group. The reaction temperatures are from about 80 to 200° C., and, to prepare the amides, the water of reaction formed is removed continuously. However, the reaction does not have to be carried out completely to the amide but rather from 0 to 100 mol % of the amine used may be present in the form of the ammonium salt. Under similar conditions, the compounds mentioned under B1) may also be prepared.

Useful amines of the formula

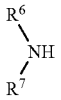

are in particular dialkylamines in which $R^6$, $R^7$ are each a straight-chain alkyl radical having from 10 to 30 carbon atoms, preferably from 14 to 24 carbon atoms. Specific mention may be made of dioleylamine, dipalmitamine, dicoconut fatty amine and dibehenylamine, and preferably ditallow fatty amine.

3. Quaternary ammonium salts of the formula $^+NR^6R^7R^8R^{11}X^-$ where $R^6$, $R^7$ and $R^8$ are each as defined above and $R^{11}$ is $C_1$-$C_{30}$-alkyl, preferably $C_1$-$C_{22}$-alkyl, $C_1$-$C_{30}$-alkenyl, preferably $C_1$-$C_{22}$-alkenyl, benzyl or a radical of the formula $—(CH_2—CH_2—O)_n—R^{12}$ where $R^{12}$ is hydrogen or a fatty acid radical of the formula $C(O)—R^{13}$ where $R^{13}$=$C_6$-$C_{40}$-alkenyl, n is a number from 1 to 30 and X is halogen, preferably chlorine, or a methosulfate.

Examples of such quaternary ammonium salts include:

dihexadecyldimethylammonium chloride, distearyldimethyl-ammonium chloride, quaternization products of esters of di- and triethanolamine with long-chain fatty acids (lauric acid, myristic acid, palmitic acid, stearic acid, behenic acid, oleic acid and fatty acid mixtures such as coconut fatty acid, tallow fatty acid, hydrogenated tallow fatty acid, tall oil fatty acid), such as N-methyltriethanolammonium distearyl ester chloride, N-methyltriethanolammonium distearyl ester methosulfate, N,N-dimethyldiethanolammonium distearyl ester chloride, N-methyltriethanolammonium dioleyl ester chloride, N-methyltriethanolammonium trilauryl ester methosulfate, N-methyltriethanolammonium tristearyl ester methosulfate and mixtures thereof.

4. Compounds of the formula

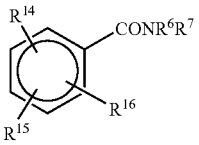

in which $R^{14}$ is $CONR^6R^7$ or $CO_2^{-+}H_2NR^6R^7$, $R^{15}$ and $R^{16}$ are each H, $CONR^{17}_2$, $CO_2R^{17}$ or $OCOR^{17}$, —$OR^{17}$, —$R^{17}$ or —$NCOR^{17}$, and $R^{17}$ is alkyl, alkoxyalkyl or polyalkoxyalkyl, and has at least 10 carbon atoms.

Preferred carboxylic acids or acid derivatives are phthalic acid (anhydride), trimellitic, pyromellitic acid (dianhydride), isophthalic acid, terephthalic acid, cyclohexanedicarboxylic acid (anhydride), maleic acid (anhydride), alkenylsuccinic acid (anhydride). The formulation (anhydride) means that the anhydrides of the acids mentioned are also preferred acid derivatives.

When the compounds of the above formula are amides or amine salts, they are preferably obtained from a secondary amine which contains a hydrogen- and carbon-containing group having at least 10 carbon atoms.

It is preferred that $R^{17}$ contains from 10 to 30, in particular from 10 to 22, for example from 14 to 20, carbon atoms and is preferably straight-chain or branched at the 1- or 2-position. The other hydrogen- and carbon-containing groups may be shorter, for example contain less than 6 carbon atoms, or may, if desired, have at least 10 carbon atoms. Suitable alkyl groups include methyl, ethyl, propyl, hexyl, decyl, dodecyl, tetradecyl, eicosyl and docosyl (behenyl).

Additionally suitable are polymers which contain at least one amide or ammonium group bonded directly to the framework of the polymer, in which case the amide or ammonium group bears at least one alkyl group of at least 8 carbon atoms on the nitrogen atom. Such polymers may be prepared in various ways. One way is to use a polymer which contains a plurality of carboxylic acid or anhydride groups, and to react this polymer with an amine of the formula $NHR^6R^7$, in order to obtain the desired polymer.

Suitable polymers for this purpose are generally copolymers of unsaturated esters such as $C_1$-$C_{40}$-alkyl (meth) acrylates, di($C_1$-$C_{40}$-alkyl) fumarates, $C_1$-$C_{40}$-alkyl vinyl ethers, $C_1$-$C_{40}$-alkyl vinyl esters or $C_2$-$C_{40}$-olefins (linear, branched, aromatic) with unsaturated carboxylic acids or their reactive derivatives, for example carboxylic anhydrides (acrylic acid, methacrylic acid, maleic acid, fumaric acid, tetrahydrophthalic acid, citraconic acid, preferably maleic anhydride).

Carboxylic acids are reacted preferably with from 0.1 to 1.5 mol, in particular from 0.5 to 1.2 mol, of amine per acid group, carboxylic anhydrides preferably with from 0.1 to 2.5 mol, in particular from 0.5 to 2.2 mol, of amine per acid anhydride group, forming, depending on the reaction conditions, amides, ammonium salts, amide-ammonium salts or imides. This results in copolymers which contain the unsaturated carboxylic anhydrides, or, in the case of the reaction with a secondary amine, as a consequence of the reaction with the anhydride group, half amide and half amine salts. By heating, water can be eliminated to form the diamide.

Particularly suitable examples of amide group-containing polymers for the use according to the invention are:

5. Copolymers (a) of a dialkyl fumarate, maleate, citraconate or itaconate with maleic anhydride, or (b) of vinyl esters, e.g. vinyl acetate or vinyl stearate, with maleic anhydride, or (c) of a dialkyl fumarate, maleate, citraconate or itaconate with maleic anhydride and vinyl acetate.

Particularly suitable examples of these polymers are copolymers of didodecyl fumarate, vinyl acetate and maleic anhydride; ditetradecyl fumarate, vinyl acetate and maleic anhydride; dihexadecyl fumarate, vinyl acetate and maleic anhydride; or the corresponding copolymers in which the itaconate is used instead of the fumarate.

In the abovementioned examples of suitable polymers, the desired amide is obtained by reacting the polymer which contains anhydride groups with a secondary amine of the formula $HNR^6R^7$ (optionally also with an alcohol when an esteramide is formed). When polymers which contain an anhydride group are reacted, the resulting amino groups will be ammonium salts and amides. Such polymers may be used with the proviso that they contain at least two amide groups.

It is essential that the polymer which contains at least two amide groups contains at least one alkyl group having at least 10 carbon atoms. This long-chain group which may be a straight-chain or branched alkyl group may be bonded via the nitrogen atom of the amide group.

The amines suitable for this purpose may be represented by the formula $R^6R^7NH$ and the polyamines by $R^6NH[R^{19}NH]_xR^7$ where $R^{19}$ is a bivalent hydrocarbon group, preferably an alkylene or hydrocarbon-substituted alkylene group, and x is an integer, preferably in the range from 1 to 30. Preferably, one of the two or both $R^6$ and $R^7$ radicals contain at least 10 carbon atoms, for example from 10 to 20 carbon atoms, for example dodecyl, tetradecyl, hexadecyl or octadecyl.

Examples of suitable secondary amines are dioctylamine and those which contain alkyl groups having at least 10 carbon atoms, for example didecylamine, didodecylamine, dicocoamine (i.e. mixed $C_{12}$-$C_{14}$-amines), dioctadecylamine, hexadecyloctadecylamine, di(hydrogenated tallow)amine (approximately 4% by weight of n-$C_{14}$-alkyl, 30% by weight of n-$C_{10}$-alkyl, 60% by weight of n-$C_{18}$-alkyl, the remainder is unsaturated).

Examples of suitable polyamines are N-octadecylpropanediamine, N,N'-dioctadecylpropanediamine, N-tetradecylbutanediamine and N,N'-dihexadecylhexanediamine, N-cocopropylenediamine ($C_{12}$/$C_{14}$-alkylpropylenediamine), N-tallow propylenediamine ($C_{16}$/$C_{18}$-alkylpropylenediamine).

The amide-containing polymers typically have an average molecular weight (number-average) of from 1000 to 500 000, for example from 10 000 to 100 000.

6. Copolymers of styrene, of its derivatives or aliphatic olefins having from 2 to 40 carbon atoms, preferably having from 6 to 20 carbon atoms, and olefinically unsaturated carboxylic acids or carboxylic anhydrides which have been reacted with amines of the formula $HNR^6R^7$. The reaction may be carried out before or after the polymerization.

Specifically, the structural units of the copolymers derive, for example, from maleic acid, fumaric acid, tetrahydrophthalic acid, citraconic acid, preferably maleic anhydride. They may be used either in the form of their homopolymers or of the copolymers. Suitable comonomers are: styrene and alkylstyrenes, straight-chain and branched olefins having from 2 to 40 carbon atoms, and also their mixtures with each other. Examples include: styrene, α-methylstyrene, dimethylstyrene, α-ethylstyrene, diethylstyrene, isopropylstyrene, tert-butylstyrene, ethylene, propylene, n-butylene, diisobutylene, decene, dodecene, tetradecene, hexadecene, octadecene. Preference is given to styrene and isobutene, particular preferably to styrene.

Examples of specific polymers include: polymaleic acid, a molar styrene/maleic acid copolymer having an alternating structure, styrene/maleic acid copolymers in a ratio of 10:90 and having a random structure, and an alternating copolymer of maleic acid and isobutene. The molar masses of the polymers are generally from 500 g/mol to 20 000 g/mol, preferably from 700 to 2000 g/mol.

The reaction of the polymers or copolymers with the amines is effected at temperatures of from 50 to 200° C. over the course of from 0.3 to 30 hours. The amine is employed in amounts of about one mole per mole of copolymerized dicarboxylic anhydride, i.e. from approx. 0.9 to 1.1 mol/mol. The use of greater or lesser amounts is possible, but brings no advantage. When amounts larger than one mole are used, some ammonium salts are obtained, since the formation of a second amide moiety requires higher temperatures, longer residence times and separation of water. Where amounts smaller than one mole are employed, there is incomplete conversion to the monoamide and a correspondingly reduced action is obtained.

Instead of the subsequent reaction of the carboxyl groups in the form of the dicarboxylic anhydride with amines to give the corresponding amides, it may sometimes be advantageous to prepare the monoamides of the monomers and then to directly copolymerize them in the polymerization. However, this is technically far more complicated, since the amines can add to the double bond of the monomeric mono- and dicarboxylic acid and copolymerization is then no longer possible.

7. Copolymers consisting of from 10 to 95 mol % of one or more alkyl acrylates or alkyl methacrylates with $C_1$-$C_{26}$-alkyl chains and of from 5 to 90 mol % of one or more ethylenically unsaturated dicarboxylic acids or their anhydrides, the copolymer having been converted substantially to the monoamide or amide/ammonium salt of the dicarboxylic acid using one or more primary or secondary amines.

From 10 to 95 mol %, preferably from 40 to 95 mol % and more preferably from 60 to 90 mol %, of the copolymers consists of alkyl (meth)acrylates, and from 5 to 90 mol %, preferably from 5 to 60 mol % and more preferably from 10 to 40 mol %, of the copolymers consist of the olefinically unsaturated dicarboxylic acid derivatives. The alkyl groups of the alkyl (meth)acrylates contain of from 1 to 26, preferably from 4 to 22 and more preferably from 8 to 18, carbon atoms. They are preferably straight-chain and unbranched. However, up to 20% by weight of cyclic and/or branched fractions may also be present.

Examples of particularly preferred alkyl (meth)acrylates are n-octyl (meth)acrylate, n-decyl (meth)acrylate, n-dodecyl (meth)acrylate, n-tetradecyl (meth)acrylate, n-hexadecyl (meth)acrylate and n-octadecyl (meth) acrylate and also mixtures thereof.

Examples of ethylenically unsaturated dicarboxylic acids are maleic acid, tetrahydrophthalic acid, citraconic acid and itaconic acid and their anhydrides, and also fumaric acid. Preference is given to maleic anhydride.

Useful amines are compounds of the formula $HNR^6R^7$.

In general, it is advantageous to use the dicarboxylic acids in the form of the anhydrides, where available, in the copolymerization, for example maleic anhydride, itaconic anhydride, citraconic anhydride and tetrahydrophthalic anhydride, since the anhydrides generally copolymerize better with the (meth)acrylates. The anhydride groups of the copolymers may then be reacted directly with the amines.

The reaction of the polymers with the amines is effected at temperatures of from 50 to 200° C. over the course of from 0.3 to 30 hours. The amine is employed in amounts of from about one to two mol per mole of copolymerized dicarboxylic anhydride, i.e. from approx. 0.9 to 2.1 mol/mol. The use of greater or lesser amounts is possible, but brings no advantage. When amounts greater than two moles are employed, free amine is present. When amounts smaller than one mole are employed, there is incomplete conversion to the monoamide and a correspondingly reduced action is obtained.

In some cases, it may be advantageous when the amide/ammonium salt structure is composed of two different amines. For example, a copolymer of lauryl acrylate and maleic anhydride may first be reacted with a secondary amine such as hydrogenated ditallow fatty amine to give the amide, whereupon the free carboxyl group stemming from the anhydride is neutralized with another amine, for example 2-ethylhexylamine, to give the ammonium salt. The reverse procedure is equally conceivable: initial reaction with ethylhexylamine to give the monoamide is followed by reaction with ditallow fatty amine to give the ammonium salt. Preference is given to using at least one amine which has at least one straight-chain, unbranched alkyl group having more than 16 carbon atoms. It is unimportant whether this amine is present in the construction of the amide structure or as the ammonium salt of the dicarboxylic acid.

Instead of the subsequent reaction of the carboxyl groups or of the dicarboxylic anhydride with amines to give the corresponding amides or amide/ammonium salts, it may sometimes be advantageous to prepare the monoamides or amide/ammonium salts of the monomers and then to copolymerize them directly in the polymerization. However, this is usually far more technically complicated since the amines can add to the double bond of the monomeric dicarboxylic acid and copolymerization is then no longer possible.

8. Terpolymers based on α,β-unsaturated dicarboxylic anhydrides, α, β-unsaturated compounds and polyoxyalkylene ethers of lower, unsaturated alcohols, which are characterized in that they contain 20-80 mol %, preferably 40-60 mol %, of bivalent structural units of the formulae 1 and/or 3, and also optionally 2, the structural units 2 stemming from unconverted anhydride radicals (1)

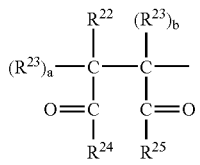

-continued (2)

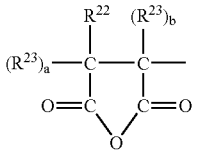

(3)

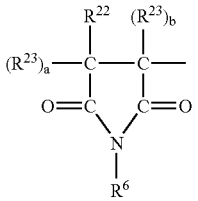

where $R^{22}$ and $R^{23}$ are each independently hydrogen or methyl, a, b are each zero or one and a+b equals one, $R^{24}$ and $R^{25}$ are the same or different and are each the —$NHR^6$, $N(R^6)_2$ and/or —$OR^{27}$ groups, and $R^{27}$ is a cation of the formula $H_2N(R^6)_2$ or $H_3NR^6$, 19-80 mol %, preferably 39-60 mol %, of bivalent structural units of the formula 4

(4)

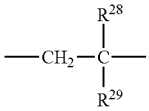

where $R^{28}$ is hydrogen or $C_1$-$C_4$-alkyl and $R^{29}$ is $C_6$-$C_{60}$-alkyl or $C_6$-$C_{18}$-aryl and 1-30 mol %, preferably 1-20 mol %, of bivalent structural units of the formula 5

(5)

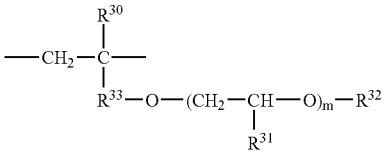

where $R^{30}$ is hydrogen or methyl, $R^{31}$ is hydrogen or $C_1$-$C_4$-alkyl, $R^{33}$ is $C_1$-$C_4$-alkylene, m is a number from 1 to 100, $R^{32}$ is $C_1$-$C_{24}$-alkyl, $C_5$-$C_{20}$-cycloalkyl, $C_6$-$C_{18}$-aryl or —$C(O)R^{34}$ where $R^{34}$ is $C_1$-$C_{40}$-alkyl, $C_5$-$C_{10}$-cycloalkyl or $C_6$-$C_{18}$-aryl.

The aforementioned alkyl, cycloalkyl and aryl radicals may optionally be substituted. Suitable substituents of the alkyl and aryl radicals are, for example, ($C_1$-$C_6$)alkyl, halogens such as fluorine, chlorine, bromine and iodine, preferably chlorine, and ($C_1$-$C_6$)alkoxy.

Alkyl here is a straight-chain or branched hydrocarbon radical. Specific examples include: n-butyl, tert-butyl, n-hexyl, n-octyl, decyl, dodecyl, tetradecyl, hexadecyl, octadecyl, dodecenyl, tetrapropenyl, tetradecenyl, pentapropenyl, hexadecenyl, octadecenyl and eicosanyl or mixtures such as cocoalkyl, tallow fat alkyl and behenyl.

Cycloalkyl here is a cyclic aliphatic radical having 5-20 carbon atoms. Preferred cycloalkyl radicals are cyclopentyl and cyclohexyl.

Aryl here is an optionally substituted aromatic ring system having from 6 to 18 carbon atoms.

The terpolymers consist of the bivalent structural units of the formulae 1 and 3 and also 4 and 5 and optionally 2. In a manner known per se, they also contain only the end groups formed in the polymerization by initiation, inhibition and chain breaking.

Specifically, the structural units of the formulae 1 to 3 derive from α,β-unsaturated dicarboxylic anhydrides of the formulae 6 and 7

(6)

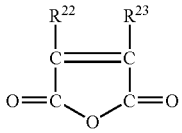

(7)

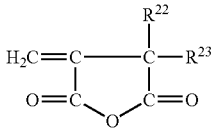

such as maleic anhydride, itaconic anhydride, citraconic anhydride, preferably maleic anhydride.

The structural units of the formula 4 derive from the α,β-unsaturated compounds of the formula 8.

(8)

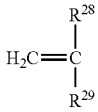

The following α,β-unsaturated olefins are mentioned by way of example: styrene, α-methylstyrene, dimethylstyrene, α-ethylstyrene, diethylstyrene, isopropylstyrene, tert-butylstyrene, diisobutylene and α-olefins, such as decene, dodecene, tetradecene, pentadecene, hexadecene, octadecene, $C_{20}$-α-olefin, $C_{24}$-α-olefin, $C_{30}$-α-olefin, tripropenyl, tetrapropenyl, pentapropenyl and mixtures thereof. Preference is given to α-olefins having from 10 to 24 carbon atoms and styrene, particular preference to α-olefins having from 12 to 20 carbon atoms.

The structural units of the formula 5 derive from polyoxyalkylene ethers of lower, unsaturated alcohols of the formula 9.

(9)

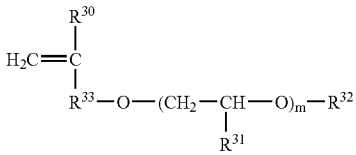

The monomers of the formula 9 are etherification products ($R^{32}$=—$C(O)R^{34}$) or esterification products ($R^{32}$=—$C(O)R^{34}$) of polyalkylene ethers ($R^{32}$=H).

The polyoxyalkylene ethers ($R^{32}$=H) can be prepared by known processes by adding α-olefin oxides, such as ethylene oxide, propylene oxide and/or butylene oxide, to polymerizable lower, unsaturated alcohols of the formula 10

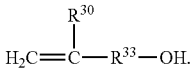

(10)

Such polymerizable lower unsaturated alcohols are, for example, allyl alcohol, methallyl alcohol, butenols such as 3-buten-1-ol and 1-buten-3-ol, or methylbutenols such as 2-methyl-3-buten-1-ol, 2-methyl-3-buten-2-ol and 3-methyl-3-buten-1-ol. Preference is given to addition products of ethylene oxide and/or propylene oxide to allyl alcohol.

A subsequent etherification of these polyoxyalkylene ethers to give compounds of the formula 9 where $R^{32}$=$C_1$-$C_{24}$-alkyl, cycloalkyl or aryl is effected by processes known per se. Suitable processes are disclosed, for example, by J. March, Advanced Organic Chemistry, 2nd edition, p. 357 f (1977). These etherification products of the polyoxyalkylene ethers can also be prepared by adding α-olefin oxides, preferably ethylene oxide, propylene oxide and/or butylene oxide, to alcohols of the formula 11

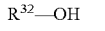

$R^{32}$—OH (11)

where $R^{32}$ is $C_1$-$C_{24}$-alkyl, $C_5$-$C_{20}$-cycloalkyl or $C_6$-$C_{18}$-aryl, by known methods, and reacting with polymerizable lower, unsaturated halides of the formula 12

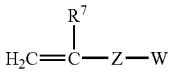

(12)

where W is a halogen atom. The halides used are preferably the chlorides and bromides. Suitable preparative processes are mentioned, for example, in J. March, Advanced Organic Chemistry, 2nd edition, p. 357 f (1977).

The esterification of the polyoxyalkylene ethers ($R^{32}$=—C(O)—$R^{34}$) is effected by reaction with customary esterifying agents such as carboxylic acids, carbonyl halides, carboxylic anhydrides or carboxylic esters with $C_1$-$C_4$-alcohols. Preference is given to using the halides and anhydrides of $C_1$-$C_{40}$-alkyl-, $C_5$-$C_{10}$-cycloalkyl- or $C_6$-$C_{18}$-arylcarboxylic acids. The esterification is generally carried out at temperatures of from 0 to 200° C., preferably from 10 to 100° C.

In the monomers of the formula 9, the index m indicates the degree of alkoxylation, i.e. the number of moles of α-olefin which are added per mole of the formula 20 or 21.

Suitable primary amines for preparing the terpolymers include, for example, the following:

n-hexylamine, n-octylamine, n-tetradecylamine, n-hexadecylamine, n-stearylamine or else N,N-dimethylaminopropylenediamine, cyclohexylamine, dehydroabietylamine and also mixtures thereof.

Suitable secondary amines for preparing the terpolymers include, for example: didecylamine, ditetradecylamine, distearylamine, dicoconut fat amine, ditallow fat amine and mixtures thereof.

The terpolymers have K values (measured according to Ubbelohde in 5% by weight solution in toluene at 25° C.) of from 8 to 100, preferably from 8 to 50, corresponding to average molecular weights ($M_w$) of between approx. 500 and 100 000. Suitable examples are detailed in EP 606 055.

9. Reaction products of alkanolamines and/or polyetheramines with polymers containing dicarboxylic anhydride groups, characterized in that they contain 20-80 mol %, preferably 40-60 mol %, of bivalent structural units of the formulae 13 and 15 and optionally 14

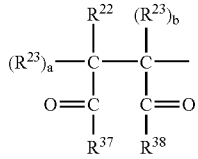

(13)

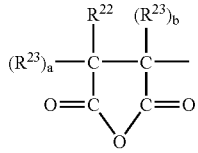

(14)

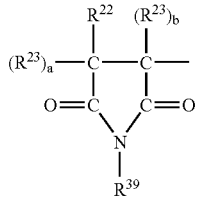

(15)

where $R^{22}$ and $R^{23}$ are each independently hydrogen or methyl, a, b are each zero or 1 and a+b equals 1, $R^{37}$=—OH, —O-[$C_1$-$C_{30}$-alkyl], —$NR^6R^7$, —$O^sN'R^6R^7H_2$ $R^{38}$=$R^{37}$ or $NR^6R^{39}$ $R^{39}$=—$(A—O)_x$—E where A=ethylene or propylene group x=from 1 to 50

E=H, $C_1$-$C_{30}$-alkyl, $C_5$-$C_{12}$-cycloalkyl or $C_6$-$C_{30}$-aryl, and 80-20 mol %, preferably 60-40 mol %, of bivalent structural units of the formula 4.

Specifically, the structural units of the formulae 13, 14 and 15 derive from α,β-unsaturated dicarboxylic anhydrides of the formulae 6 and/or 7.

The structural units of the formula 4 derive from the α,β-unsaturated olefins of the formula 8. The aforementioned alkyl, cycloalkyl and aryl radicals have the same definitions as under 8.

The $R^{37}$ and $R^{38}$ radicals in formula 13 and the $R^{39}$ radical in formula 15 derive from polyetheramines or alkanolamines of the formulae 16 a) and b), amines of the formula $NR^6R^7R^8$, and also optionally from alcohols having from 1 to 30 carbon atoms.

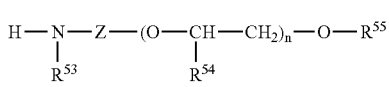

(16a)

-continued (16b)

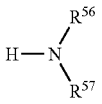

In these formulae, $R^{53}$ is hydrogen, $C_6$-$C_{40}$-alkyl or (16c)

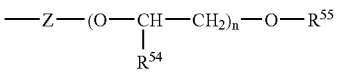

$R^{54}$ is hydrogen, $C_1$-$C_4$-alkyl, $R^{55}$ is hydrogen, $C_1$- to $C_4$-alkyl, $C_5$- to $C_{12}$-cycloalkyl or $C_6$- to $C_{30}$-aryl, $R^{56}$, $R^{57}$ are each independently hydrogen, $C_1$- to $C_{22}$-alkyl, $C_2$- to $C_{22}$-alkenyl or Z—OH, Z is $C_2$- to $C_4$-alkylene, n is a number between 1 and 1000.

To derivatize the structural units of the formulae 6 and 7, preference is given to using mixtures of at least 50% by weight of alkylamines of the formula $HNR^6R^7R^8$ and at most 50% by weight of polyetheramines, alkanolamines of the formulae 16 a) and b).

It is possible to prepare the polyetheramines used, for example, by reductively aminating polyglycols. The preparation of polyetheramines having a primary amino group also succeeds by adding polyglycols to acrylonitrile and subsequently catalytically hydrogenating. It is additionally possible to obtain polyetheramines by reacting polyethers with phosgene or thionyl chloride and subsequently aminating to give the polyetheramine. The polyetheramines used according to the invention are commercially available (for example) under the name ®Jeffamine (Texaco). Their molecular weight is up to 2000 g/mol and the ethylene oxide/propylene oxide ratio is from 1:10 to 6:1.

A further possibility for derivatizing the structural units of the formulae 6 and 7 is, instead of the polyetheramines, to use an alkanolamine of the formulae 16a) or 16b) and subsequently subject it to an oxalkylation.

Per mole of anhydride, from 0.01 to 2 mol, preferably from 0.01 to 1 mol, of alkanolamine are used. The reaction temperature is between 50 and 100° C. (amide formation). In the case of primary amines, the conversion is effected at temperatures above 100° C. (imide formation).

The oxalkylation is typically effected at temperatures between 70 and 170° C. with catalysis by bases, such as NaOH or $NaOCH_3$, by injecting gaseous alkylene oxides such as ethylene oxide (EO) and/or propylene oxide (PO). Typically, per mole of hydroxyl groups, from 1 to 500 mol, preferably from 1 to 100 mol, of alkylene oxide are added.

Examples of suitable alkanolamines include:

monoethanolamine, diethanolamine, N-methylethanolamine, 3-aminopropanol, isopropanol, diglycolamine, 2-amino-2-methylpropanol and mixtures thereof.

Examples of primary amines include the following:

n-hexylamine, n-octylamine, n-tetradecylamine, n-hexadecylamine, n-stearylamine and also N,N-dimethylaminopropylenediamine, cyclohexylamine, dehydroabietylamine and mixtures thereof.

Examples of secondary amines include:

didecylamine, ditetradecylamine, distearylamine, dicoconut fat amine, ditallow fat amine and mixtures thereof.

Examples of alcohols include:

methanol, ethanol, propanol, isopropanol, n-, sec-, tert-butanol, octanol, tetradecanol, hexadecanol, octadecanol, tallow fat alcohol, behenyl alcohol and mixtures thereof. Suitable examples are listed in EP-A-688 796.

10. Co- and terpolymers of N-$C_6$-$C_{24}$-alkylmaleimide with $C_1$-$C_{30}$-vinyl esters, vinyl ethers and/or olefins having from 1 to 30 carbon atoms, for example styrene or α-olefins. These are obtainable either by reacting a polymer containing anhydride groups with amines of the formula $H_2NR^6$ or by imidating the dicarboxylic acid and subsequently copolymerizing. A preferred dicarboxylic acid is maleic acid or maleic anhydride. Preference is given to copolymers which are composed of from 10 to 90% by weight of $C_6$-$C_{24}$-α-olefins and from 90 to 10% by weight of N-$C_6$-$C_{22}$-alkylmaleimide.

Comb polymers can be described, for example, by the formula

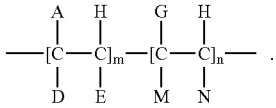

In this formula,

A is R', COOR', OCOR', R"—COOR' or OR';

D is H, $CH_3$, A or R;

E is H or A;

G is H, R", R"—COOR', an aryl radical or a heterocyclic radical;

M is H, COOR", OCOR", OR" or COOH;

N is H, R", COOR", OCOR, COOH or an aryl radical;

R' is a hydrocarbon chain having 8-150 carbon atoms;

R" is a hydrocarbon chain having from 1 to 10 carbon atoms;

m is a number between 0.4 and 1.0; and n is a number between 0 and 0.6.

The mixing ratio (in parts by weight) of the additives according to the invention with paraffin dispersants, resins and comb polymers is in each case from 1:10 to 20:1, preferably from 1:1 to 10:1.

The additive components according to the invention may be added to mineral oils or mineral oil distillates separately or in a mixture. In a preferred embodiment, the individual additive constituents or else the corresponding mixture are dissolved or dispersed in an organic solvent or dispersant before the addition to the middle distillates. The solution or dispersion generally contains 5-90% by weight, preferably 5-75% by weight, of the additive or additive mixture.

Suitable solvents or dispersants in this context are aliphatic and/or aromatic hydrocarbons or hydrocarbon mixtures, for example benzine fractions, kerosene, decane, pentadecane, toluene, xylene, ethylbenzene or commercial solvent mixtures such as Solvent Naphtha, ®Shellsol AB, ®Solvesso 150, ®Solvesso 200, ®Exxsol, ®ISOPAR and ®Shellsol D types. Polar solubilizers such as 2-ethylhexanol, decanol, isodecanol or isotridecanol may optionally also be added.

Mineral oils or mineral oil distillates having cold properties improved by the additives according to the invention contain from 0.001 to 2% by weight, preferably from 0.005 to 0.5% by weight, of the additives, based on the mineral oil or mineral oil distillate.

The additives according to the invention are especially suitable for improving the cold flow properties of animal, vegetable or mineral oils. At the same time, they improve the dispersancy of the precipitated paraffins below the cloud point. They are particularly suitable for use in middle distillates. Middle distillates refer in particular to those mineral oils which are obtained by distilling crude oil and boil in the range from 120 to 450° C., for example kerosene, jet fuel, diesel and heating oil. Preference is given to using the additives according to the invention in low-sulfur middle distillates which contain 350 ppm of sulfur and less, more preferably less than 200 ppm of sulfur and in particular less than 50 ppm of sulfur. The additives according to the invention are also preferably used in those middle distillates which have 95% distillation points below 365° C., especially 350° C. and in special cases below 330° C., and contain high contents of paraffins having from 18 to 24 carbon atoms but only small fractions of paraffins having chain lengths of 24 and more carbon atoms. They may also be used as components in lubricant oils.

The mineral oils and mineral oil distillates may also comprise further customary additives, for example dewaxing auxiliaries, corrosion inhibitors, antioxidants, lubricity additives, sludge inhibitors, cetane number improvers, detergency additives, dehazers, conductivity improvers or dyes.

EXAMPLES

The following esters A) were used as a 50% solution in aromatic solvent (EO stands for ethylene oxide; PO stands for propylene oxide):

TABLE 1

Characterization of the esters used (constituent A)

| Additive | Polyol | Alkoxylation | Main constituents of the fatty acids $C_{18}$ | $C_{20}$ | $C_{22}$ | Acid number [mg KOH/g] | OH number [mg KOH/g] |
|---|---|---|---|---|---|---|---|
| A1 | Glycerol | 22 mol EO | 2 | 7 | 88 | 7 | 13 |
| A2 | Glycerol | 22 mol EO | 95% | | | 5 | 4 |
| A3 | Glycerol | 22 mol EO | 37 | 10 | 48 | 1 | 2 |
| A4 | Glycerol | 16 mol PO | 37 | 10 | 48 | 7 | 9 |
| A5 | Glycerol | 16 mol PO | 2 | 7 | 88 | 5 | 7 |
| A6 | Glycerol | 24 mol PO | 37 | 10 | 48 | 8 | 11 |
| A7 | Glycerol | 10 mol EO | 2 | 7 | 88 | 7 | 9 |
| A8 | Glycerol | 30 mol EO | 2 | 7 | 88 | 2 | 4 |
| A9 | Glycerol | 40 mol EO | 2 | 7 | 88 | 12 | 10 |
| A10 | Glycerol | 20 mol EO | 36 | 36 | 24 | 13 | 13 |
| A11 | Glycerol | 20 mol EO | 2 | 7 | 88 | 0.5 | 11 |
| A12 | Glycerol | 15 mol EO | 2 | 7 | 88 | 5 | 7 |
| A13(C) | Ethylene glycol | 13 mol EO | 37 | 10 | 48 | 0.9 | 4 |
| A14(C) | Glycerol | — | 2 | 7 | 88 | 0.2 | 4 |
| A15 | Glycerol ethoxylate (20 mol EO) esterified with mixture of behenic acid (2% $C_{18}$, 7% $C_{20}$, 88% $C_{22}$) and 10 mol % of poly(isobutenylsuccinic anhydride) (MW 1000 g/mol) | | | | | | |

Characterization of the ethylene copolymers used as flow improvers (constituent B))

The viscosity was measured to ISO 3219/B using a rotational viscometer (Haake RV20) having a cone-and-plate measuring system at 140° C.

| Additive No. | Comonomers (apart from ethylene) | $V_{140}$ |
|---|---|---|
| B1) | 32% by wt. of vinyl acetate | 125 mPas |
| B2) | 31% by wt. of vinyl acetate + 8% by wt. of vinyl decanoate | 110 mPas |
| B3) | Mixture of copolymers B1) and B2) in a ratio of 1:5 | |

The additives are used as 50% solutions in Solvent Naphtha or kerosene to improve the ease of handling.

Characterization of the alkylphenol-aldehyde resins used (constituent C))

C 1) nonylphenol-formaldehyde resin

C 2) dodecylphenol-formaldehyde resin

C 3) $C_{20/24}$-alkylphenol-formaldehyde resin

Characterization of the paraffin dispersants used (constituent D))

D 1) reaction product of a dodecenyl-spiro-bislactone with a mixture of primary and secondary tallow fat amine D 2) reaction product of a terpolymer of $C_{14}/C_{16}$-α-olefin, maleic anhydride and allyl polyglycol with 2 equivalents of ditallow fat amine.

Characterization of the Test Oils:

The boiling parameters were determined to ASTM D-86, the CFPP value to EN 116 and the cloud point to ISO 3015.

TABLE 2

| | Parameters of the test oils | | | |
|---|---|---|---|---|
| | Test oil 1 | Test oil 2 | Test oil 3 | Test oil 4 |
| Initial boiling point [° C.] | 169 | 200 | 174 | 241 |
| 20% [° C.] | 211 | 251 | 209 | 256 |
| 90% [° C.] | 327 | 342 | 327 | 321 |
| 95% [° C.] | 344 | 354 | 345 | 341 |
| Cloud point [° C.] | −9.0 | −4.2 | −6.7 | −8.2 |
| CFPP [° C.] | −10 | −6 | −8 | −10 |
| Sulfur content | 33 ppm | 35 ppm | 210 ppm | 45 ppm |

Effectiveness of the Additives

In Table 4, the superior effectiveness compared to the prior art of the additives according to the invention together with ethylene copolymers for mineral oils and mineral oil distillates is described with reference to the CFPP test (Cold Filter Plugging Test to EN 116).

The paraffin dispersancy in middle distillates was determined in the short sedimentation test as follows:

150 ml of the middle distillates, admixed with the additive components specified in the table, were cooled in 200 ml measuring cylinders in a cold cabinet at −2° C./hour to −13° C. and stored at this temperature for 16 hours. Subsequently, volume and appearance, both of the sedimented paraffin phase and the supernatant oil phase, were determined and assessed visually. A small amount of sediment with a simultaneously homogeneously cloudy oil phase or a large volume of sediment with a clear oil phase show good paraffin dispersancy. In addition, the lower 20% by vol. was isolated and the cloud point determined to ISO 3015. Only a small deviation of the cloud point of the lower phase ($CP_{CC}$) from the blank value of the oil shows good paraffin dispersancy.

TABLE 3

CFPP effectiveness in test oil 1
The CFPP effectiveness of the esters A according to the invention was measured in combination with the same amounts of C and D in test oil 1 as follows:

| | | | | B3 in ppm | | |
|---|---|---|---|---|---|---|
| | A | C | D | 50 | 75 | 100 |
| Example 1 | 50 ppm A1 | 50 ppm C1 | 50 ppm D2 | −29 | −31 | −30 |
| Example 2 | 50 ppm A11 | 50 ppm C2 | 50 ppm D1 | −27 | −30 | −30 |
| Example 3 | 50 ppm A7 | 50 ppm C1 | 50 ppm D2 | −17 | −28 | −29 |
| Example 4 | 50 ppm A12 | 50 ppm C1 | 50 ppm D2 | −19 | −31 | −29 |
| Example 5 | 50 ppm A8 | 50 ppm C1 | 50 ppm D2 | −21 | −29 | −29 |
| Example 6 | 50 ppm A9 | 50 ppm C1 | 50 ppm D2 | −18 | −24 | −29 |
| Example 7 | 50 ppm A2 | 50 ppm C1 | 50 ppm D2 | −26 | −29 | −28 |
| Example 8 | 50 ppm A3 | 50 ppm C1 | 50 ppm D2 | −30 | −27 | −30 |
| Example 9 | 50 ppm A5 | 50 ppm C1 | 50 ppm D2 | −22 | −29 | −30 |
| Example 10 | 50 ppm A10 | 50 ppm C1 | 50 ppm D2 | −19 | −30 | −29 |
| Example 11 | 50 ppm A6 | 50 ppm C1 | 50 ppm D2 | −16 | −26 | −29 |
| Example 12 | 50 ppm A15 | 50 ppm C1 | 50 ppm D2 | −28 | −30 | −31 |
| Example 13 (comparative) | 50 ppm A13 | 50 ppm C1 | 50 ppm D2 | −14 | −22 | −28 |
| Example 14 (comparative) | — | 75 ppm C1 | 75 ppm D2 | −12 | −17 | −21 |

TABLE 4

CFPP effectiveness in test oil 2
The additive constituents A were mixed with 5 parts of B2) and tested for their CFPP effectiveness in test oil 2.

| | | CFPP [0° C.] | | |
|---|---|---|---|---|
| | Constituent A | 100 ppm | 200 ppm | 300 ppm |
| Example 15 | A1 | −11 | −20 | −21 |
| Example 16 | A2 | −11 | −22 | −23 |
| Example 17 | A3 | −10 | −20 | −22 |
| Example 18 | A4 | −10 | −18 | −23 |
| Example 19 (comparative) | A13 | −8 | −10 | −17 |
| Example 20 (comparative) | — | −6 | −8 | −9 |

TABLE 5

CFPP and dispersancy action in test oil 3
For the dispersion tests in test oil 3, an additional 200 ppm of the additive B1) were metered into all measurements.

| | Additives | | Test oil 3 (CP −6.7° C.) | | | |
|---|---|---|---|---|---|---|
| | A | C | Sediment [% by vol.] | Appearance of oil phase | CFPP [° C.] | $CP_{CC}$ [° C.] |
| Example 21 | 100 ppm A1 | 50 ppm C1 | 0 | turbid | −23 | −5.9 |
| Example 22 | 100 ppm A1 | 50 ppm C2 | 7 | turbid | −24 | −3.3 |
| Example 23 | 100 ppm A2 | 50 ppm C2 | 10 | turbid | −21 | −2.4 |
| Example 24 | 100 ppm A1 | 50 ppm C3 | 20 | cloudy | −21 | −0.8 |
| Example 25 | 50 ppm A2 | 100 ppm C1 | 20 | cloudy | −26 | −1.4 |
| Example 26 | 100 ppm A3 | 50 ppm C1 | 10 | turbid | −28 | −1.4 |
| Example 27 | 50 ppm A3 | 100 ppm C1 | 0 | turbid | −28 | −5.3 |
| Example 28 | 100 ppm A4 | 100 ppm C1 | 7 | turbid | −21 | −3.6 |
| Example 29 | 50 ppm A4 | 100 ppm C1 | 13 | turbid | −27 | −2.0 |
| Example 30 | 100 ppm A5 | 50 ppm C1 | 3 | turbid | −22 | −6.1 |
| Example 31 | 50 ppm A5 | 100 ppm C1 | 15 | turbid | −22 | −2.0 |
| Example 32 | 100 ppm A6 | 50 ppm C1 | 20 | cloudy | −23 | −1.6 |
| Example 33 | 50 ppm A6 | 100 ppm C1 | 3 | turbid | −21 | −4.4 |
| Example 34 | 100 ppm A15 | 50 ppm C1 | 0 | turbid | −25 | −6.2 |
| Example 35 (C) | 100 ppm A14 | 50 ppm C1 | 16 | clear | −18 | +3.0 |
| Example 36 | 150 ppm A1 | — | 20 | clear | −20 | +3.4 |
| Example 37 | 150 ppm A2 | — | 20 | clear | −19 | +3.2 |
| Example 38 (C) | — | 150 ppm C1 | 10 | cloudy | −20 | +0.1 |
| Example 39 (C) | — | — | 25 | clear | −19 | +3.6 |

TABLE 6

CFPP and dispersancy action in test oil 4
For the dispersancy tests in test oil 4, an additional 200 ppm of additive B1 were metered into all measurements.

| | Additives | | Test oil 4 (CP −8.2° C.) | | | |
|---|---|---|---|---|---|---|
| | A | C | Sediment [% by vol.] | Appearance of oil phase | CFPP [° C.] | $CP_{CC}$ [° C.] |
| Example 40 | 100 ppm A1 | 100 ppm C1 | 0 | turbid | −24 | −6.3 |
| Example 41 | 100 ppm A1 | 100 ppm C1 | 0 | turbid | −24 | −7.5 |
| Example 42 | 50 ppm A3 | 100 ppm C1 | 0 | turbid | −24 | −5.4 |
| Example 43 | 50 ppm A3 | 100 ppm C1 | 0 | turbid | −28 | −5.3 |
| Example 44 | 100 ppm A5 | 50 ppm C1 | 50 | cloudy | −23 | −3.3 |
| Example 45 | 100 ppm A5 | 100 ppm C1 | 0 | turbid | −23 | −5.5 |
| Example 46 | 50 ppm A5 | 100 ppm C1 | 70 | cloudy | −24 | −4.3 |
| Example 47 (C) | 100 ppm A14 | 50 ppm C1 | 16 | clear | −18 | −1.1 |

TABLE 6-continued

CFPP and dispersancy action in test oil 4
For the dispersancy tests in test oil 4, an additional 200 ppm of additive B1 were metered into all measurements.

| | Additives | | Test oil 4 (CP −8.2° C.) | | | |
|---|---|---|---|---|---|---|
| | A | C | Sediment [% by vol.] | Appearance of oil phase | CFPP [° C.] | $CP_{CC}$ [° C.] |
| Example 48 | 150 ppm A1 | — | 20 | clear | −21 | +2.4 |
| Example 49 (C) | — | 150 ppm C1 | 35 | cloudy | −20 | +1.2 |
| Example 50 (C) | — | — | 20 | clear | −18 | +2.6 |

TABLE 7

CFPP and dispersancy action in test oil 1
For all dispersancy tests in test oil 1, an additional 75 ppm of additive B3 were metered into all measurements

| | Additives | | | Test oil 1 (CP −9.0° C.) | | | |
|---|---|---|---|---|---|---|---|
| | A | C | D | Sediment [% by vol.] | Appearance of oil phase | CFPP [° C.] | $CP_{CC}$ [° C.] |
| Example 51 | 50 ppm A1 | 50 ppm C1 | 50 ppm D2 | 0 | turbid | −29 | −7.2 |
| Example 52 | 80 ppm A1 | 90 ppm C1 | 90 ppm D2 | 0 | turbid | −30 | −8.0 |
| Example 53 | 50 ppm A2 | 50 ppm C1 | 50 ppm D2 | 0 | turbid | −27 | −7.4 |
| Example 54 | 50 ppm A3 | 50 ppm C1 | 50 ppm D2 | 0 | turbid | −29 | −6.7 |
| Example 55 | 50 ppm A4 | 50 ppm C1 | 50 ppm D2 | 0.5 | turbid | −28 | −6.0 |
| Example 56 | 50 ppm A6 | 50 ppm C1 | 50 ppm D2 | 0.5 | turbid | −28 | −6.7 |
| Example 57 | 100 ppm A1 | 50 ppm C1 | — | 0.3 | turbid | −24 | −6.7 |
| Example 58 | 150 ppm A2 | — | 50 ppm D2 | 10 | cloudy | −24 | −0.5 |
| Example 59 (C) | — | 50 ppm C1 | 100 ppm D2 | 2 | turbid | −25 | −4.5 |
| Example 60 (C) | — | — | — | 25 | clear | −21 | 2.2 |

The invention claimed is:

1. A method for improving the cold flow properties and paraffin dispersancy of a middle distillate having a maximum sulfur content of 0.05% by weight comprising the step of adding to the middle distillate an additive including at least one fatty acid ester of an alkoxylated polyol (A) having an OH number of at most 15 mg KOH/g and also at least one cold flow improver (B), said cold flow improver including at least one copolymer of ethylene and one or more ethylenically unsaturated carboxylic acid ester, having an ethylene fraction of from 60 to 90 mol %, and the polyol containing at least 3 OH groups.

2. The method of claim 1, wherein the at least one fatty acid ester of an alkoxylated polyol (A) is derived from a polyol having three or more OH groups which has been reacted with from 1 to 100 mol of alkylene oxide.

3. The method of claim 1, wherein the at least one fatty acid ester of an alkoxylated polyol (A) is an ester of a fatty acid having from 12 to 50 carbon atoms.

4. The method of claim 1, wherein the at least one fatty acid ester of alkoxylated polyol (A) is an ester of a mixture of at least one fatty acid having from 12 to 50 carbon atoms and at least one fat-soluble polybasic carboxylic acid.

5. The method of claim 1, wherein the at least one fatty acid ester of an alkoxylated polyol (A) is derived from alkoxylated glycerol.

6. The method of claim 1, wherein the ethylene copolymer contains at least one unsaturated vinyl ester of an aliphatic carboxylic acid having from 2 to 15 carbon atoms.

7. The method of claim 1, wherein the additive further comprises an alkylphenol-aldehyde resin (C).

8. The method of claim 7, wherein the alkyl radicals of the alkylphenol-aldehyde resin (C) have from 1 to 50 carbon atoms.

9. The method of claim 7, wherein the alkylphenol-aldehyde resin (C) is derived from at least one aldehyde having from 1 to 10 carbon atoms.

10. The method of claim 1, wherein the additive further comprising a polar nitrogen-containing paraffin dispersant comprises an amine salt or an amide of a secondary fatty amine having from 8 to 36 carbon atoms or mixtures thereof.

* * * * *